US006038957A

United States Patent [19]

Ertmann et al.

[11] Patent Number: 6,038,957

[45] Date of Patent: Mar. 21, 2000

[54] CONTROL VALVES

[75] Inventors: Alexander Gareth Ertmann; Mark Sadler, both of Lincolnshire, United Kingdom

[73] Assignee: Commercial Intertech Limited, Grantham, United Kingdom

[21] Appl. No.: 09/091,125

[22] PCT Filed: Dec. 12, 1996

[86] PCT No.: PCT/GB96/03061

§ 371 Date: Jun. 15, 1998

§ 102(e) Date: Jun. 15, 1998

[87] PCT Pub. No.: WO97/22809

PCT Pub. Date: Jun. 26, 1997

[30] Foreign Application Priority Data

Dec. 15, 1995 [GB] United Kingdom ..... 9525617
Dec. 15, 1995 [GB] United Kingdom ..... 9525618

[51] Int. Cl.[7] ..... F15B 11/08

[52] U.S. Cl. ..... 91/461; 137/625.6; 251/35

[58] Field of Search ..... 71/461, 364, 454; 137/596.14, 625.61, 625.6; 251/35

[56] References Cited

U.S. PATENT DOCUMENTS

| | | | |
|---|---|---|---|
| 3,954,249 | 5/1976 | Gratzmuller | 91/461 X |
| 3,972,267 | 8/1976 | Haak et al. | 91/461 X |
| 4,616,476 | 10/1986 | Oneyama et al. | 91/461 X |
| 4,955,283 | 9/1990 | Hidaka et al. | 91/461 |
| 4,958,553 | 9/1990 | Ueno | 91/461 X |
| 5,170,692 | 12/1992 | Lonnemo . | |
| 5,207,059 | 5/1993 | Schexnayder . | |

FOREIGN PATENT DOCUMENTS

| | | |
|---|---|---|
| 0297682 | 1/1984 | European Pat. Off. . |
| 0354972 | 2/1990 | European Pat. Off. . |
| 2853795 | 6/1979 | Germany . |

OTHER PUBLICATIONS

Hydraulic "Transistor", Machine Design, vol. 64, No. 11, p. 70, Jun. 11, 1992.

*Primary Examiner*—Hoang Nguyen
*Attorney, Agent, or Firm*—Ratner & Prestia

[57] ABSTRACT

A hydraulic control valve (10; 110) which acts as a hydraulic flow amplifier. An obturator (34; 134) is slidable towards and away from a valve seat (36; 136) to controllably vary throughflow from an inlet (S; P) to an outlet (T; S). The obturator (34; 134) is mounted on a piston (30; 130) which is slidable in dependence on the excess of the difference between inlet and outlet pressures over control pressure in a control chamber (42; 142). The control chamber (42; 142) is fed with hydraulic fluid bled from the source (S; P) via a controlled leak (48+50; 148+150) which is self-regulating in dependence on throughflow-controlling movement of the piston/obturator (34/30; 134/130) in a sense which provides negative feedback. The control chamber (42; 142) is drained through a fluid conduit (54; 154) incorporating an externally-controllable fluid flow restriction (56; 156) which serves as the control input to the control valve (10; 110). The control valve (10) can be configured to control outflow from a load-connected service line (S) to a flow drain or reservoir (T), or, alternatively, the valve (110) can be configured to control inflow from a pressure source (P) to a load-connected service line (S). The invention may be used in both single acting and double acting applications.

15 Claims, 7 Drawing Sheets

CONTROL VALVES

This invention relates to control valves and relates more particularly but not exclusively to flow-amplifying hydraulic control valves.

In the field of hydraulic control valves intended to pass controllably variable flow rates (as distinct from valves which are simply "open/shut" valves), it is generally easier to provide precise control of small flow rates whereas the loads require high flow rates. In principle, a solution to this requirement is the provision of a flow amplifier, but a flow amplifier requires to be capable of accurately tracking a variable control input. A flow amplifier should also desirably avoid undue complexity and cost, be reliable, and easily adjustable to compensate for performance variations due, for example, to tolerance limitations in manufacture.

According to a first aspect of the present invention there is provided a control valve for controlling the flow of fluid through the valve in proportional dependence upon a variable control input, the control valve comprising flow control means providing a controllably variable fluid throughput in use of the control valve, said throughput being controlled in dependence upon pressure in a control chamber fed with fluid tapped from the upstream side of the valve via a control element, fluid being drained from the chamber under external control to vary pressurisation of the chamber as the control input to the control valve, the control element being coupled to the flow control means to vary the feed to the control chamber in dependence upon the fluid throughput and in a sense providing negative feedback.

The fluid whose flow is to be controlled by the control valve is preferably a hydraulic fluid.

The control element is preferably a variable flow restriction disposed to provide a flow restriction which reduces with increased fluid throughput through the flow control means of the valve, the flow restriction conversely increasing with reduced fluid throughput through the flow control means of the valve.

According to a second aspect of the present invention there is provided a flow-amplifying hydraulic control valve for controlling the flow of fluid through the valve in proportional dependence upon a variable control flow which is volumetrically small relative to the controlled throughflow, the control valve comprising a valve housing having a fluid inlet and a fluid outlet mutually joined by an internal fluid passage, a valve seat bounding the internal fluid passage, a bore in the valve housing, the bore intersecting the fluid passage in the region of the valve seat, an obturator controllably movable along the bore towards and away from the valve seat respectively to reduce and to increase the flow of fluid through the valve in use of the control valve, the obturator and the valve seat being shaped and dimensioned such that a forward pressure differential across the valve arising from the fluid pressure in the fluid inlet instantaneously exceeding the fluid pressure in the fluid outlet tends to increase displacement of the obturator from the valve seat and thereby tends to increase fluid throughput, the end of the obturator remote from the valve seat and that end of the bore together defining a variable-volume control chamber, pressurisation of the control chamber tending to decrease displacement of the obturator from the valve seat thereby to tend to decrease fluid throughput, a fluid conduit tapping the internal fluid passage between the fluid inlet and the valve seat, the fluid conduit feeding tapped fluid to the control chamber, a variable flow restriction means in the fluid conduit to provide variable restriction of fluid being fed to the control chamber, the variable flow restriction means being coupled to the obturator such that increased displacement of the obturator from the valve seat causes the flow restriction means to present a reduced restriction to flow of fluid into the control chamber and, conversely, such that decreased displacement of the obturator from the valve seat causes the flow restriction means to present an increased restriction to flow of fluid into the control chamber, and means permitting drainage of fluid from the control chamber at an externally controllable rate whereby controlled flow of fluid through the control chamber is amplified as a controlled throughput of fluid from the fluid inlet to the fluid outlet.

The fluid conduit is preferably formed in the obturator to lead from a tapping point adjacent the region of contact between the obturator and the valve seat, the tapping point being on the upstream side of said region, the fluid conduit leading by way of the fluid restriction means to a fluid discharge in the end of the obturator remote from the valve seat. The fluid restriction means preferably comprises a throttling element partially plugging the fluid discharge in the end of the obturator, the throttling element moving relative to the obturator with movement of the obturator. The throttling element is preferably held substantially static with respect to the valve housing such as to penetrate the fluid discharge to an extent which varies with movement of the obturator along the bore. The fluid discharge may be an orifice in the end face of the obturator, and the throttling element may be a pin dimensioned to be a sliding fit in the orifice, the pin having at least one longitudinal slot in its periphery to carry fluid past the orifice, the length of slot exposed to the fluid conduit upstream of the orifice being variable in proportional dependence on the displacement of the obturator from the valve seat whereby to provide a variable restriction to flow of fluid into the control chamber. The throttling element preferably has a position which is adjustable with respect to the valve housing whereby to enable adjustment of the performance characteristic of the control valve.

The fluid conduit may incorporate a check valve to prevent reverse flow from the control chamber back through the fluid conduit and the tapping point in the event of a reverse pressure differential across the valve. Such an internal check valve prevents transient depressurisation of the control chamber in the event of depressurisation of the normally high pressure fluid inlet, thereby to prevent the control valve acting as an anti-cavitation valve.

The fluid conduit may incorporate a pilot-operated hydraulic check valve or the like, selectively operable to block fluid outflow from the control chamber when the obturator is seated on the value sent whereby to eliminate leakage through the control valve when the control valve is closed. Such a hydraulic check valve is preferably one which substantially prevents reverse flow through the hydraulic check valve and allows forward flow through the hydraulic check valve only if forward differential pressure exceeds a predetermined level selectively variable in dependence on an externally applied control pressure.

The hydraulic check valve preferably comprises a valve housing having a fluid inlet and a fluid outlet mutually joined by an internal fluid passage, a valve seat bounding the internal fluid passage, a poppet movable against the valve seat to block the internal fluid passage and movable away from the valve seat to open the internal fluid passage, a piston movable towards and away from the poppet, a spring disposed between the poppet and the piston to bias the poppet towards the valve seat with the spring force being reacted by abutment with the piston, and the piston being subjectable to a selectively variable hydraulic pressure constituting said externally applied control pressure.

Embodiments of the invention will now be described by way of example, with reference to the accompanying drawings wherein.

Figure 1:
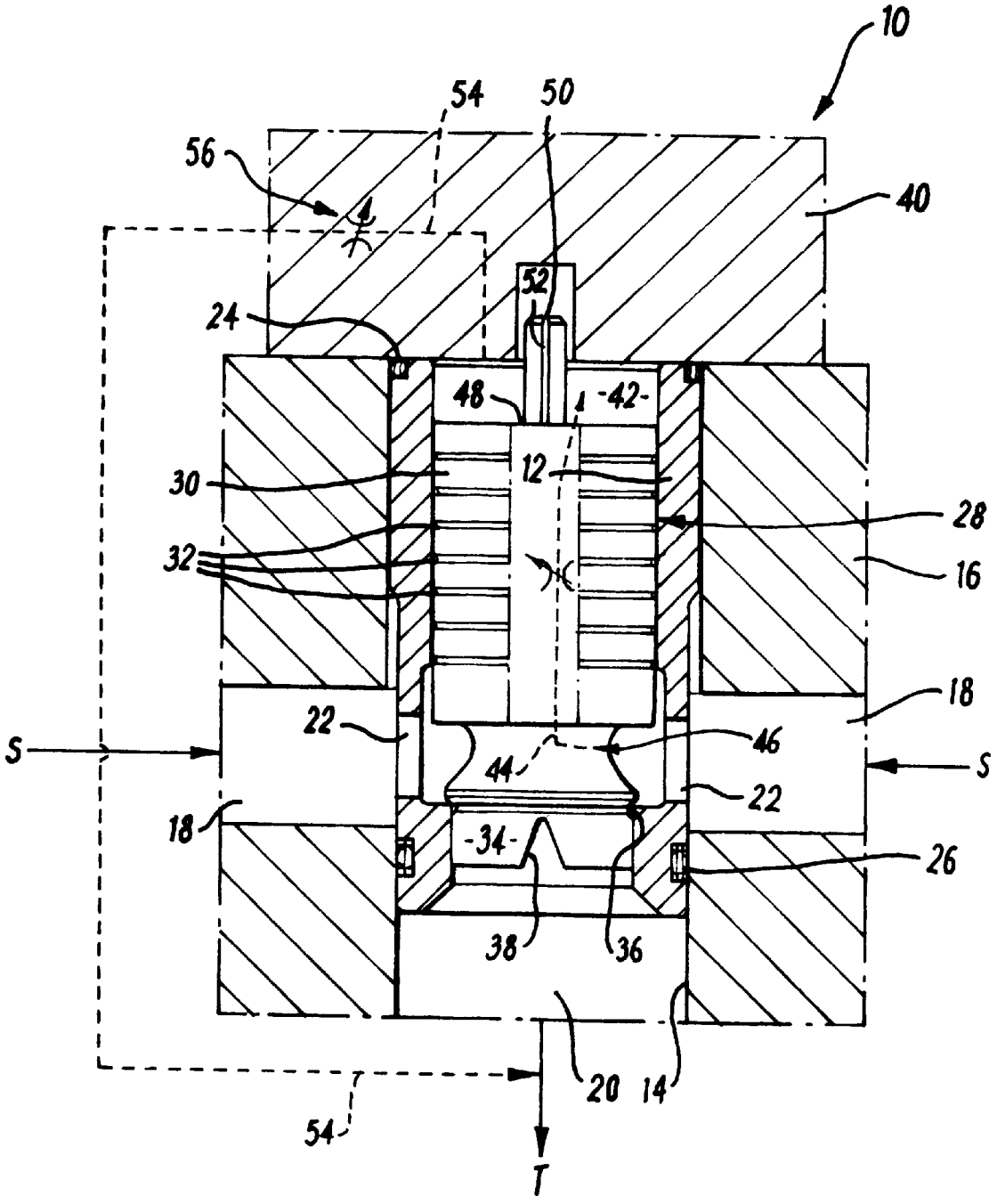
FIG. 1 is a semi-schematic longitudinal sectional elevation of a first embodiment of hydraulic control valve in accordance with the invention.
Figure 2:
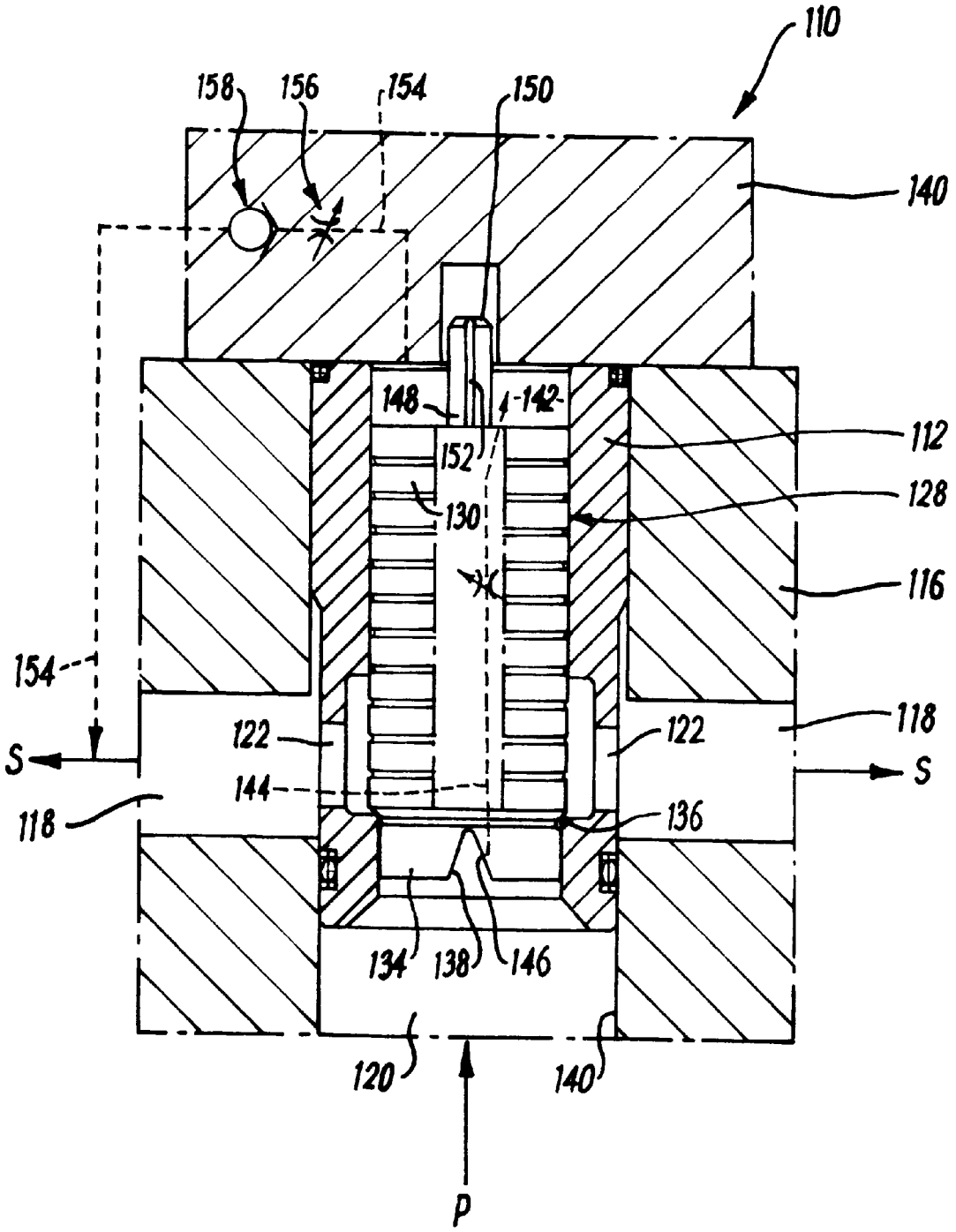
FIG. 2 is a semi-schematic longitudinal sectional elevation of a second embodiment of a hydraulic control valve in accordance with the invention.

It is to be understood that directional reference (eg "up" and "down") refer to the valves in the respective alignments shown in FIGS. 1 and 2.

Referring first to FIG. 1, a hydraulic control valve 10 comprises a generally tubular housing 12 in the form of an open-ended cylindrical sleeve (detailed below) inserted into a suitable bore 14 in a valve block 16 (only part of which is shown in FIG. 1). A transverse bore 18 functions as a fluid inlet gallery serving the valve 10, while the downward continuation of the bore 14 functions as a fluid outlet 20 from the valve 10. Side-ports 22 communicate the inlet gallery 18 to the interior of the sleeve 12 near its lower end. The sleeve 12 is externally sealed to the bore 14 through the valve block 16 by means of upper and lower ring seals 24, 26.

A poppet 28 is longitudinally slidable up and down the interior of the sleeve 12 in response to the balance of hydraulic forces on the poppet 28, as will subsequently be detailed. The upper part 30 of the poppet 28 functions as a piston which is slidingly sealed to the interior of the sleeve 12 by a series of axially-spaced circumferential grooves 32 that enhance lubrication and sealing such that resistance to movement and leakage of fluid are both insignificant.

The lower part 34 of the poppet 28 is formed as an obturator which co-operates with a circular valve seat 36 formed inside the lower end of the sleeve 12. In the configuration illustrated in FIG. 1, the obturator 34 is fully seated in the valve seat 36 such that the fluid outlet 20 is closed off from the fluid inlet gallery 18, and the fluid throughput of the valve 10 is zero.

The lower end of the obturator 34 (co-terminus with the bottom end of the poppet 28) can be profiled to match specific metering requirements and, in the embodiment illustrated, has a diametral V-shaped notch 38 which serves to control the throughput of fluid as the obturator 34 is variably lifted off the valve seat 36, by reason of the ends of the notch 38 instantaneously above the valve seat 36 presenting a varying area to fluid incoming from the inlet gallery 18 (by way of the side-ports 22), while fluid simultaneously drains freely from the notch 38 directly into the fluid outlet 20.

It is to be particularly noted that the diameter of the obturator 34 in its region of contact with the valve seat 36 is significantly less than the diameter of the piston 30. The pressure of fluid in the inlet gallery 18 exerts both upwards and downwards forces on the poppet 28, but since the cross-sectional area of the piston 30 on which the upward pressure acts is greater than the cross-sectional area of the obturator 34 on which the downward pressure acts, the upward force exceeds the downward force. In short, the poppet 28 is designed to have a pressure imbalance in a sense that inlet pressure tends to lift the obturator 34 off the valve seat 36.

The top end of the sleeve 12 is closed off by a valve block cap 40 (only part of which is shown in FIG. 1). The cap 40 seals off the upper end of the interior of the sleeve 12, except in certain respects which will be detailed subsequently. Most importantly, the underside of the cap 40, the interior of the upper end of the sleeve 12, and the top of the piston 30 together define a chamber 42 which has a volume that varies inversely with the extent by which the obturator 34 has lifted off the valve seat 36. (In the configuration shown in FIG. 1, the obturator 34 is fully down, the piston 30 is in its lowest possible position inside the sleeve 12, and consequently the volume of the chamber 42 is at its maximum). In a manner to be detailed below, the chamber 42 can be pressurised, which creates a downward force on the piston 28, ie in a direction opposite to the net upward force exerted by pressure in the inlet gallery 18 (as previously explained).

Fluid is tapped from the inlet gallery 18 (by way of the side-ports 22) by means of a fluid conduit 44 (depicted only schematically in FIG. 1) that is formed inside the poppet 28. The fluid conduit 44 leads from a tapping point 46 in the poppet 28 between the lower end of the piston 30 and the upper end of the obturator 34, the tapping point 46 being upstream of the valve seat 36. The fluid conduit 44 passes from the tapping point 46 through the body of the piston 30 to discharge through an orifice 48 within the piston 30, and into the chamber 42.

Figure 3:
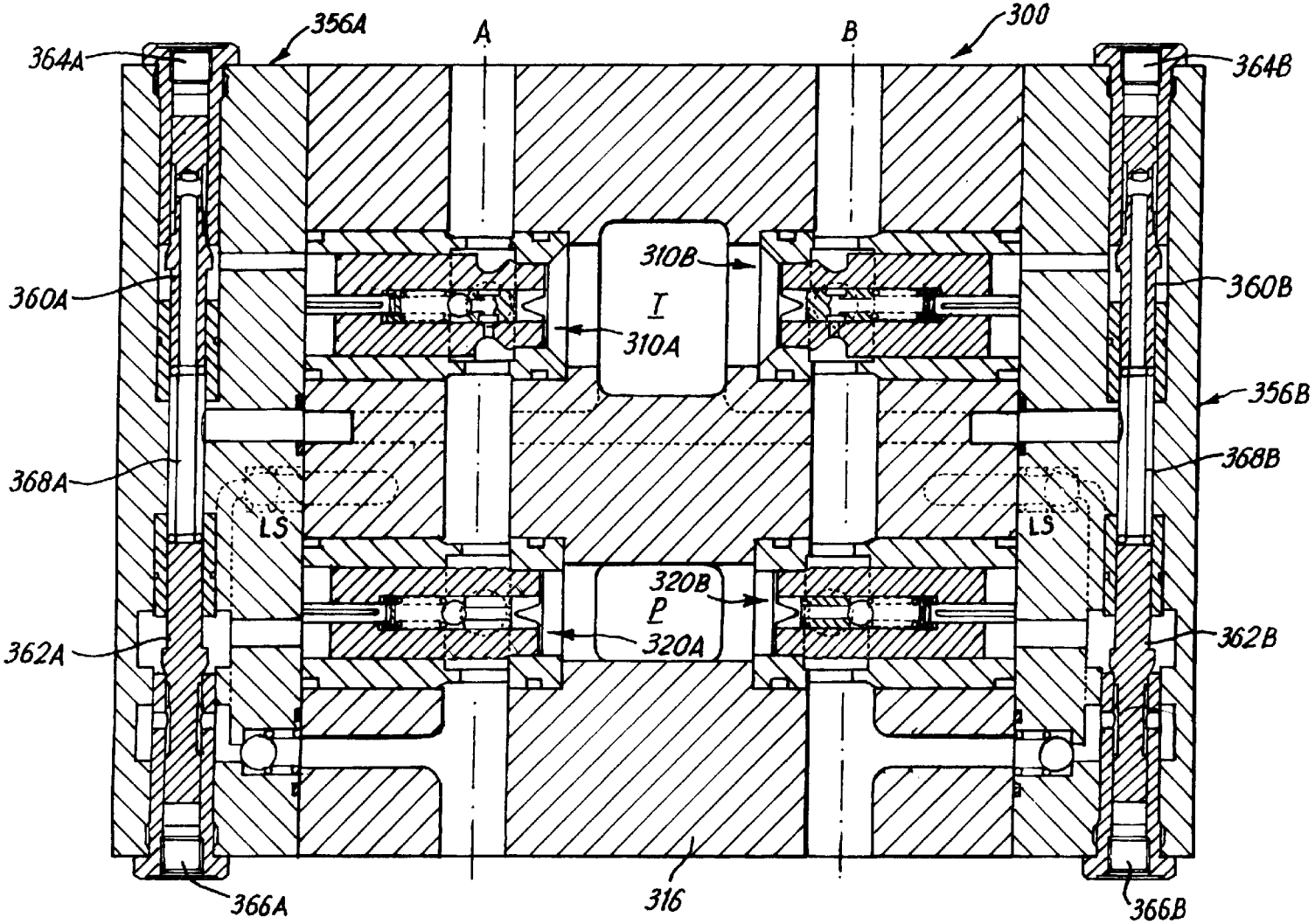
FIG. 3 is a cross-section of a control valve assembly incorporating modified forms of the control valves of FIGS. 1 and 2.

A throttling element 50 is mounted in a fixed position by means not shown in FIG. 1 so as to depend into the chamber 42 and through the orifice 48 into the conduit 44. In the form shown in FIG. 1 (and as shown in FIG. 3), the throttling element 50 is in the form of a cylindrical pin having a longitudinal slot 52 extending from the top of the pin 50 (visible in FIG. 1) to a point near but not at the bottom of the pin 50 (not visible in FIG. 1). The pin 50 is a close sliding fit in the orifice 48 such that substantially the only fluid path through the orifice 48 is by way of the slot 52. The blind lower end of the slot 52 extends into the conduit 44 by a distance which is dependent on the lift of the obturator 34 from the valve seat 36. In the configuration shown in FIG. 1, the obturator 34 is fully seated on the valve seat 34, the poppet 28 is in its lowest possible position, and the extent of slot 52 below the orifice 48 and exposed to fluid in the conduit 44 is at a minimum (or possibly zero) and consequently the restriction of flow through the orifice 48 and into the chamber 42 is at a maximum. As the obturator 34 lifts off the valve seat 36 and the poppet 28 rises inside the sleeve 12, a greater extent of the lower end of the slot 52 becomes exposed below the orifice 48 to fluid in the conduit 44 and consequently the restriction of flow of fluid from the conduit 44 through the orifice 48 and into the chamber 42 reduces.

In general, as throughput (flow from the inlet gallery 18 to the outlet 20) rises, restriction of flow through the orifice 48 falls, and inflow of tapped fluid to the chamber 42 rises. If the mounting of the pin 50 is adjustable (e.g. by rotation of a screw-thread mounting, not shown), the position of the pin 50 may be altered and fixed at a location which (for example) provided a standardised performance regardless of variations arising in manufacture, or optimised in other respects. The variable flow restriction comprising the pin 50 is symbolically depicted in FIG. 1 superimposed on the schematic depiction of the conduit 44.

At the same time as fluid is being tapped from the inlet gallery 18 and fed by way of a flow restriction to the pressurisable variable-volume chamber 42, fluid is controllably drained from the chamber 42 by way of a channel 54 including an externally variable flow restriction 56 (symbolically depicted in FIG. 1). Fluid drained from the chamber 42 is conveniently returned to the valve outlet 20. The flow restriction 56 can take any suitable form that enables the rate of flow out of the chamber 42 through the channel 54 to be externally controlled.

Operation of the valve 10 will now be described. Upon the establishment of a forward pressure differential across the valve 10, i.e. a fluid pressure in the inlet gallery 18 greater than the fluid pressure at the outlet 20, the poppet 28 tends to rise and increase the throughput (i.e. volumetric rate of flow of fluid through the valve 10 from the inlet 18 to the outlet 20). At the same time, fluid tapped from the inlet and fed into the chamber 42 tends to pressurise the chamber 42 and thereby drive the poppet 28 down thus to decrease the throughput. The balancing point, i.e. the throughput at which these opposing tendencies mutually cancel, is determined by the externally controlled setting of the variable flow restriction 56 through which fluid is drained from the chamber 42 so as to tend to depressurise the chamber 42. Deviations in throughput from the externally set balancing point have the following effect:

(1) If throughput is too low, (ie actual throughput is less than set throughput) the obturator 34 is too low and, correspondingly, the tapped flow through the pin slot 52 and into the chamber 42 is reduced. This reduces pressurisation of the chamber 42, and the poppet 28 tend to rise thereby to increase actual throughput toward the set throughput.

(2) If throughput is too high, (ie actual throughput exceeds set throughput) the obturator 34 is too high and, correspondingly, the tapped flow through the pin slot 52 and into the chamber 42 is increased. This increases pressurisation of the chamber 42, and the poppet 28 tends to sink thereby to decrease actual throughput towards the set throughput.

Thus the valve 10 acts as a flow amplifier in that the flow through the variable flow restriction constituted by the combination of the obturator 34 (with notch 38) and the valve seat 36 is an amplified version of the externally controlled flow through the variable flow restriction 56. However, the valve 10 is much more than an open-loop flow magnifier because the provision of the pressurisable control chamber 42 with its self-regulating variable fluid supply (via the orifice 48, the pin 50, and the slot 52) automatically corrects for deviation from set-point. In summary, the valve 10 is a closed-loop flow amplifier with built-in negative feedback.

The valve 10 can be modified by the incorporation of a pilot-operated check valve (not shown in FIG. 1) or a similar device into the channel 54. This optional check valve (or similar device) would have the purpose of blocking fluid outflow from the chamber 42 via the channel 54 to the outlet 20 when the obturator 34 is seated on the valve seat 35 and the valve 10 is "closed". Thereby a "sneak" path from the inlet 18 to the outlet 20 can be positively shut off in appropriate circumstances, thus rendering the valve 10 leak-proof. When the modified valve 10 subsequently requires to reopen for the controlled passage of fluid from the inlet 18 to the outlet 20, the check valve is positively opened to allow fluid to pass through the channel 54. Such positive opening of the check valve can be achieved by means of spool valve as will subsequently be described with reference to FIG. 5. A form of pilot-operated check valve suitable for use in valve 10, modified as described above, is shown in and described with reference to FIG. 6.

Referring now to FIG. 2, this shows a second embodiment of a control valve 110 which has much in common with the first embodiment 10 (described above with reference to FIG. 1). The practical significance of the differences between the first and second embodiments will subsequently be described with reference to FIG. 3.

In view of many features of the second embodiment of control valve 110 being common to the first embodiment of control valve 10, the following description will concentrate on those features of the second embodiment which are different. Accordingly, for a description of any part of the second embodiment not detailed below, reference should be made to the foregoing description of the identical or equivalent part in the first embodiment. In FIG. 2, parts which are identical or equivalent to parts shown in FIG. 1 are given the same reference numeral, but with the addition of a leading "1" (ie; the FIG. 2 references are FIG. 1 references plus 100).

Referring to FIG. 2, the inlet and outlet are reversed compared to the first embodiment, ie the transverse bore 118 is an outlet gallery, while the lower end of the bore 114 is an inlet 120. Since the tapping point 146 still requires to be on the upstream side of the valve seat 136, the tapping point 146 is transferred to the bottom end face of the obturator 134 such that the fluid conduit 144 leads straight from the inlet 120.

The structure and function of the orifice 148, the pin 150, the slot 152, and the pressurisable control chamber 142 are unaltered with respect to the first embodiment. However, the piston 128 is somewhat reduced in diameter, and is extended down to the region of the obturator 134 which seats on the (unaltered) valve seat 136. The operation of the obturator 134 (with its notch 138) and the valve seat 136 are unchanged except for the relative reversal of flow. Since the lower end of the poppet 128 is directly subject to the inlet pressure, there is no requirement in the second embodiment 110 to provide differential area in order to achieve inlet pressure lifting of the poppet, although there is no reason why there cannot be a differential area present as in the first embodiment 10 if required.

A check valve 158 is added to the pressure chamber drain channel 154 downstream of the externally controllable variable flow restriction 156 whose flow status is amplified by the valve 110 in operation. Since the gallery 118 is the fluid outlet in the second embodiment, ie, the downstream side of the valve 110, the drain channel 154 leads into the gallery 118 (rather than the outlet 20 in the valve 10).

In both embodiments of the valve 10 and 110, the fluid conduit 44, 144 (respectively) may incorporate a check valve (not shown in FIGS. 1 or 2, but see FIG. 3) within the body of the poppet 28, 128 between the tapping point 46, 146 and the discharge orifice 48, 148. Such a check valve would necessarily operate to allow flow from the tapping point 46, 146 to the control chamber 42, 142, but serve to prevent reverse flow. Such a check valve would have the function of locking-in the control flow in the control chamber 42, 142 even if the inlet pressure dropped below outlet pressure, thereby preventing the poppet 28, 128 acting as an anti-cavitation valve.

FIG. 3 shows a control valve assembly 300 incorporating modified forms of the valves previously described with reference to FIGS. 1 and 2.

A pair of modified forms 320A and 320B of the FIG. 2 valve (110) meter hydraulic fluid from a high pressure (inlet) pump conduit P into service galleries A and B respectively. A pair of modified forms 310A and 310B of the FIG. 1 valve (10) meter hydraulic fluid from the service galleries A and B respectively out to a low pressure (outlet) tank (reservoir) conduit T. The valves 310A, 310B, 320A and 320B are mounted within a common valve block 316 which is integrally formed with the conduits P and T, and the galleries A and B.

All of the valves 310A, 310B, 320A and 320B have respective springs fitted within their respective fluid conduits, which serve to spring bias their respective slotted rods (or other forms of throttling element) into fixed positions against the respective adjacent valve block caps (each containing a respective externally variable flow restriction serving as one of the control elements for the valve assembly). Of the four flow-amplifying metering valves three (310A, 320A, 320B) also utilise their respective internal springs to bias respective internal check valves (each in the form of a metal ball).

In the control valve assembly 300, the function of the externally variable flow restrictions 56 and 156 of the first and second embodiments is assumed by two sets 356A and 356B of hydraulically piloted spool valves. Each of the sets 356A and 356B is clamped on to a respective end of the valve block 316 to control the outflow from the control chambers of the valves 310A and 320A, and 310B and 320B respectively. Such control is effected by means of a pair of hydraulically piloted spools 360A and 362A within the set 356A and an identical pair of spools 360B and 262B within the set 356B. The spool 360A is unseated and increasingly opened to hydraulic throughflow from the control chamber of the valve 310A to the tank conduit T by means of increasing control pressure applied to its outboard end via a control port 364A in one end in the set 356A. The spool 362A is similarly controlled for corresponding control of the valve 320A by means of control pressure applied via control port 366A in the other end of the set 356A. A compression spring 368A between the spools 360A and 362A ensures a spool-seating tendency and inverse differential throughflows.

Components within the set 356B have the same structure and function as described above in respect of the set 356A, and are depicted by the same reference numerals, except for the substitution of "B" for "A".

The sets 356A and 356B act as pilot stages for the main flow-amplifying valves 310A, 320A, 310B and 320B, which in turn produce operator-controlled output pressures in the service galleries A and B which operate (for example) a hydraulic actuator, eg a double-acting piston/cylinder assembly functioning as a boom swivel in a self-propelled excavator.

In the arrangement shown in FIG. 3, the spool sets or pilot stages 356A and 356B are clamped on to respective ends of the valve block 316, but alternative arrangements are possible. For example, the pilot stages 356A and 356B could be replaced by respective blanking plates (not shown) which serve to close off the control chambers of the valves 310A–320B, the blanking plates being suitably ported and fitted with hydraulic connections (not shown) leading to an external pilot control arrangement (not shown) at a relatively remote location. As a different alternative arrangement, the pilot stage could be built into the main valve block, ie a suitably modified form of the valve block 316 (eg a suitably formed casting).

The arrangement of four control valves shown in FIG. 3 there are two poppets that operate the connected double-acting hydraulic device, one to meter oil from source P to load A (or B), and the other to meter the return oil from the load connected to the opposite service port from B (or A) to drain T.

Figure 4:
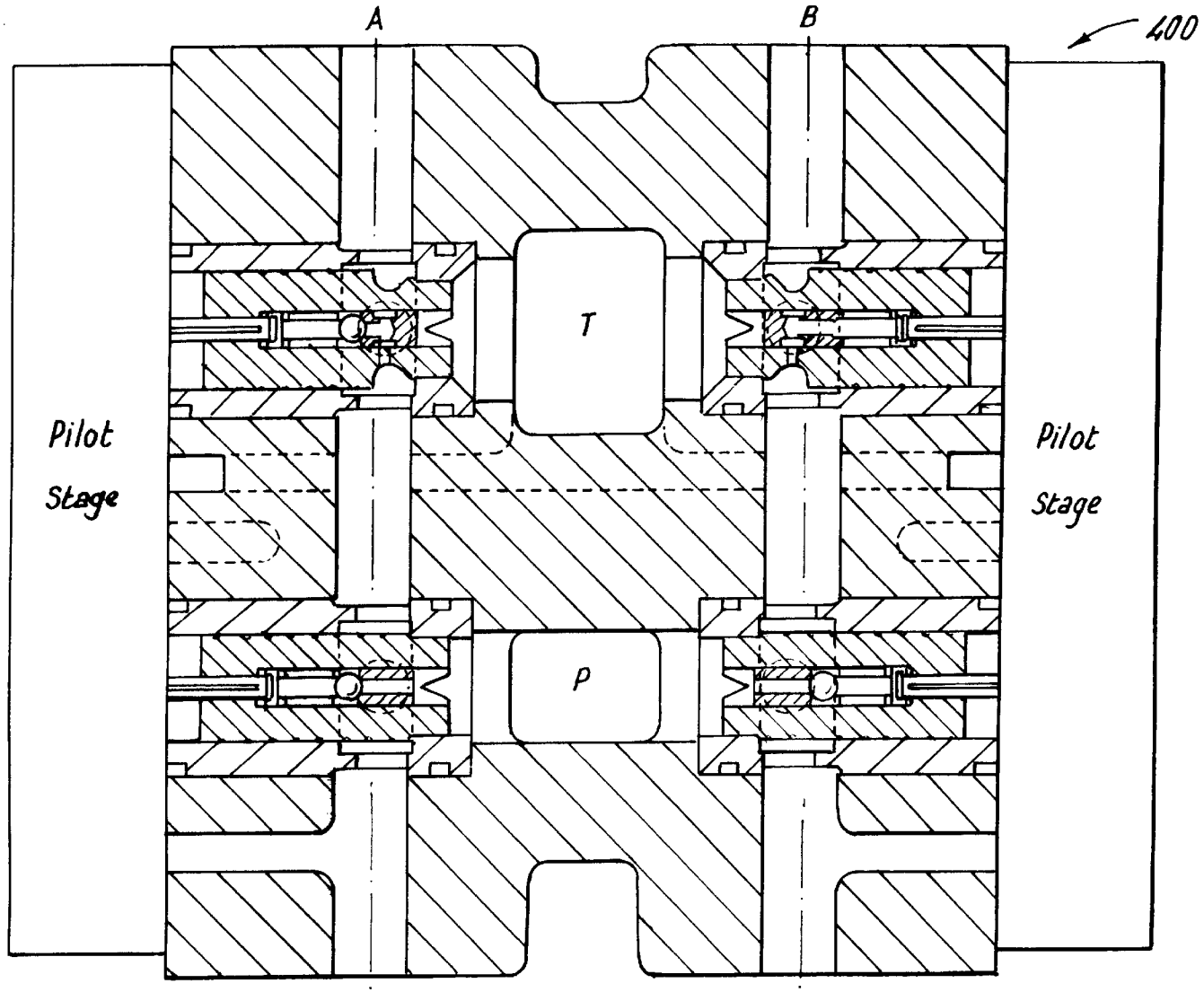
FIG. 4 is a cross-section of a control valve assembly which is a variant of the assembly of FIG. 3.

Referring now to FIG. 4, four flow-amplifying control valves or poppets (two of the type as shown in FIG. 1, two of the type as shown in FIG. 2) may be connected together, in an arrangement 400 similar to the FIG. 3 arrangement, to provide a means of fully controlling (say) a hydraulic actuator. In such an instance, it is necessary to have the timing (ie the points at which each poppet starts to open and close) controlled in a pre-determined manner to ensure correct operation. Normally it would be preferred to have the meter-out poppet (FIG. 1 type) in one fluid line, say "A", opening slightly before its counterpart meter-in poppet (FIG. 2 type) in the "B" line. In order to ensure that this relationship is maintained, irrespective of outside influences, the control of this pair of poppets may be taken over by a spool valve 556 (FIG. 5), the position of which can be controlled for example by an external hydraulic pilot signal. The general timing is determined by some fixed means (eg notches) on the spool, and the finer timing tuning is achieved by the setting of the individual feedback pins (50;150) in the main poppets (10;11O). Within such a pilot stage 556, it is of course also possible to incorporate a load-sense take-off point (555) from the meter-in flow (if required) to provide a signal for a load-sense controlled system.

In addition to this, the spool 556 may be seated on one end, where the meter-out flow is controlled. This ensures that when the spool 556 is at rest in its neutral position, the flowpath 554 from the metering element (10) to tank is closed, effectively sealing off the control flowpath 554 and, together with the seating of the obturator (34) on the valve seat (36) in the main poppet (10), creating a leakproof assembly. As the spool 556 moves, the seat is opened up and the spool meters fluid to tank via the fixed means (eg notches) on the spool, and hence opens the main poppet (10).

Figure 5:
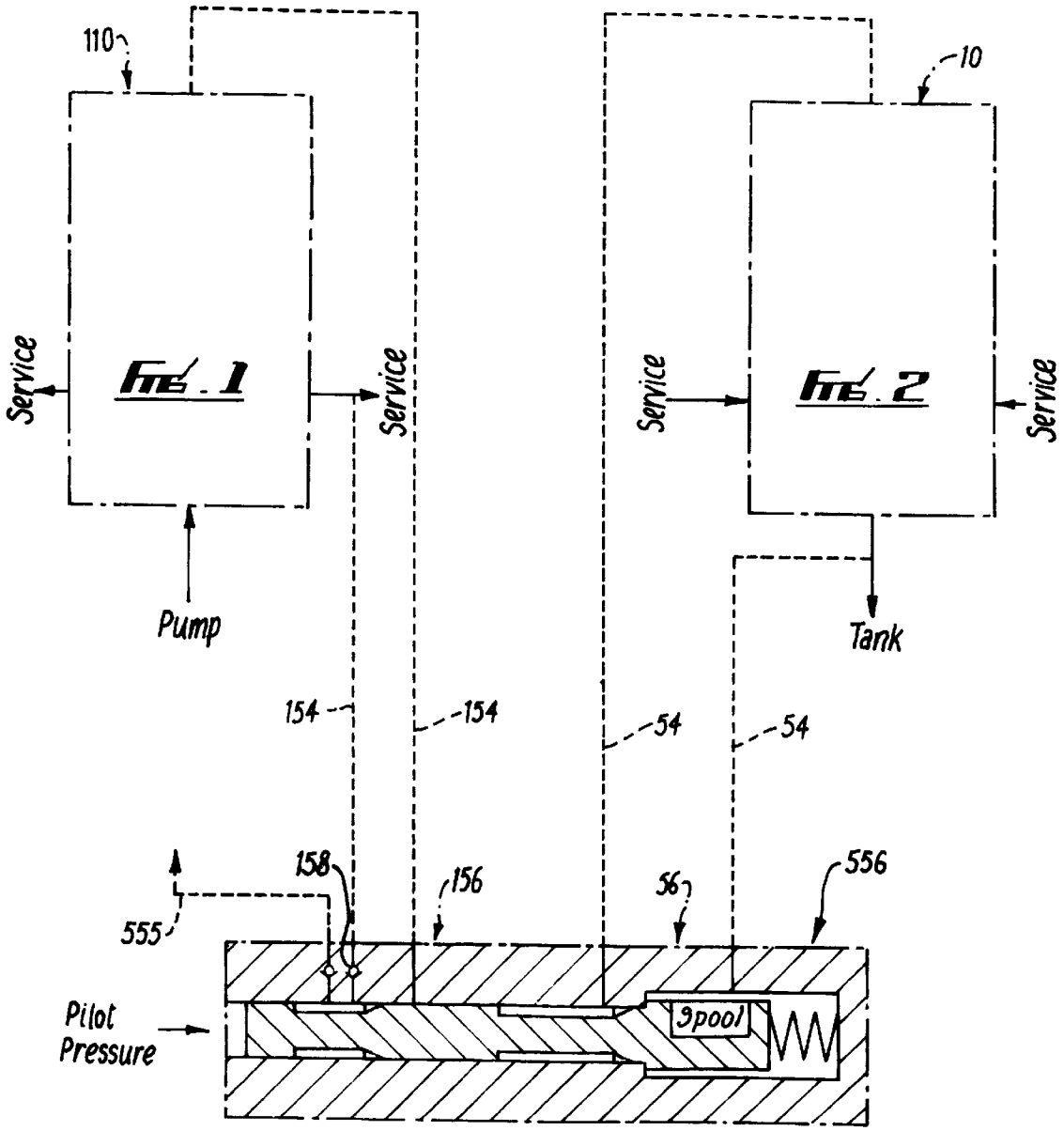
FIG. 5 is a schematic diagram of a hydraulic control system incorporating hydraulic control valves in accordance with the invention.

In an assembly such as shown in FIG. 4, one or two spool-type controllers such as are shown in FIG. 5 and which may be separate from or integral with the main poppet housing, would be employed to fully control the four poppets in the assembly; if two controllers are used, each controller controls one meter-in poppet in one fluid line and its meter-out counterpart in the other fluid line, with the second controller taking care of the other two poppets.

Figure 6:
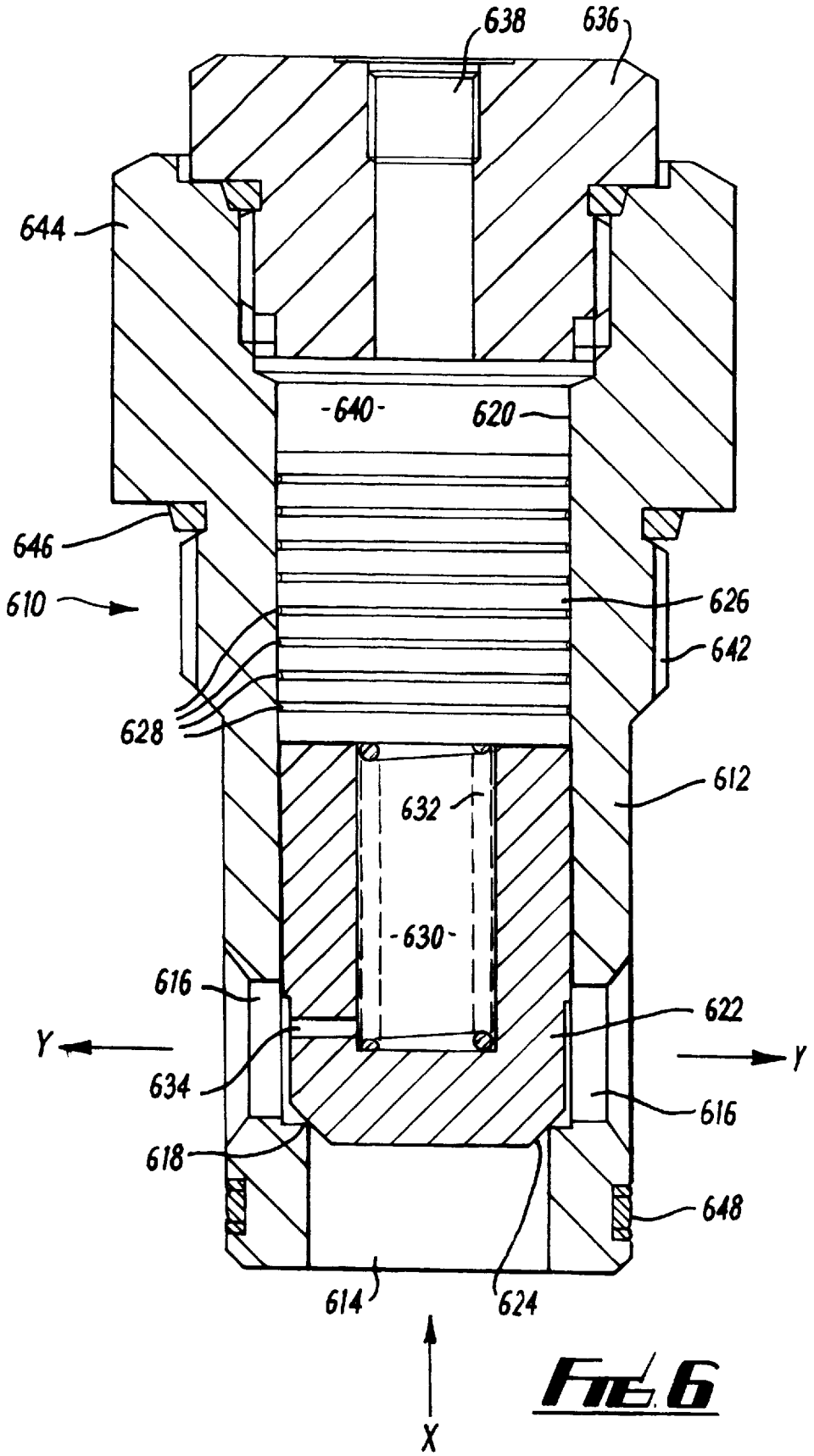
FIG. 6 is a longitudinal sectional elevation of an embodiment of hydraulic check valve which may be incorporated into or associated with the hydraulic control valves in accordance with the invention.

Referring now to FIG. 6, this shows a pilot-operated hydraulic check valve 610 suitable for use in the previously described version of the valve 10 which was modified to be leakproof when closed. The hydraulic check valve 610 comprises a hollow housing 612 having an inlet 614 and outlets 616 (which are common outlets from the downstream side of the valve 610). The housing 612 defines an internal hydraulic flow passage between the inlet 614 and the common outlets 616, and circumscribing this passage is a circular valve seat 618.

A cylindrical bore 620 extends upwards from the valve seat 618 for the remainder of the length of the housing 612, the bore 620 being coaxial with the longitudinal centre-line of the valve 610. A poppet 622 is longitudinally slidable within the bore 620, and has a bevelled lower end 624 dimensioned to make a hydraulic seal against the valve seat 618 when in contact therewith.

A piston 626 is also longitudinally slidable within the bore 620, and is located above the poppet 622 without being attached to it. The periphery of the piston 626 is longitudinally divided into an array of annular lands by a series of circumferential grooves 628 which enhance lubrication and sealing of the piston 626 to the bore 620 to ensure free movement with minimal leakage.

The poppet 622 has a recess 630 extending longitudinally downwards from its upper end towards but not as far as its lower end. A coiled compression spring 632 is lodged within the recess 630 to act against the lower end of the recess 630 to urge the poppet 622 downwards thereby to bias the bevelled lower end 624 towards and into sealing contact against the valve seat 618. The downward bias force of the spring 632 is reacted against the lower end of the piston 626.

Figure 7:
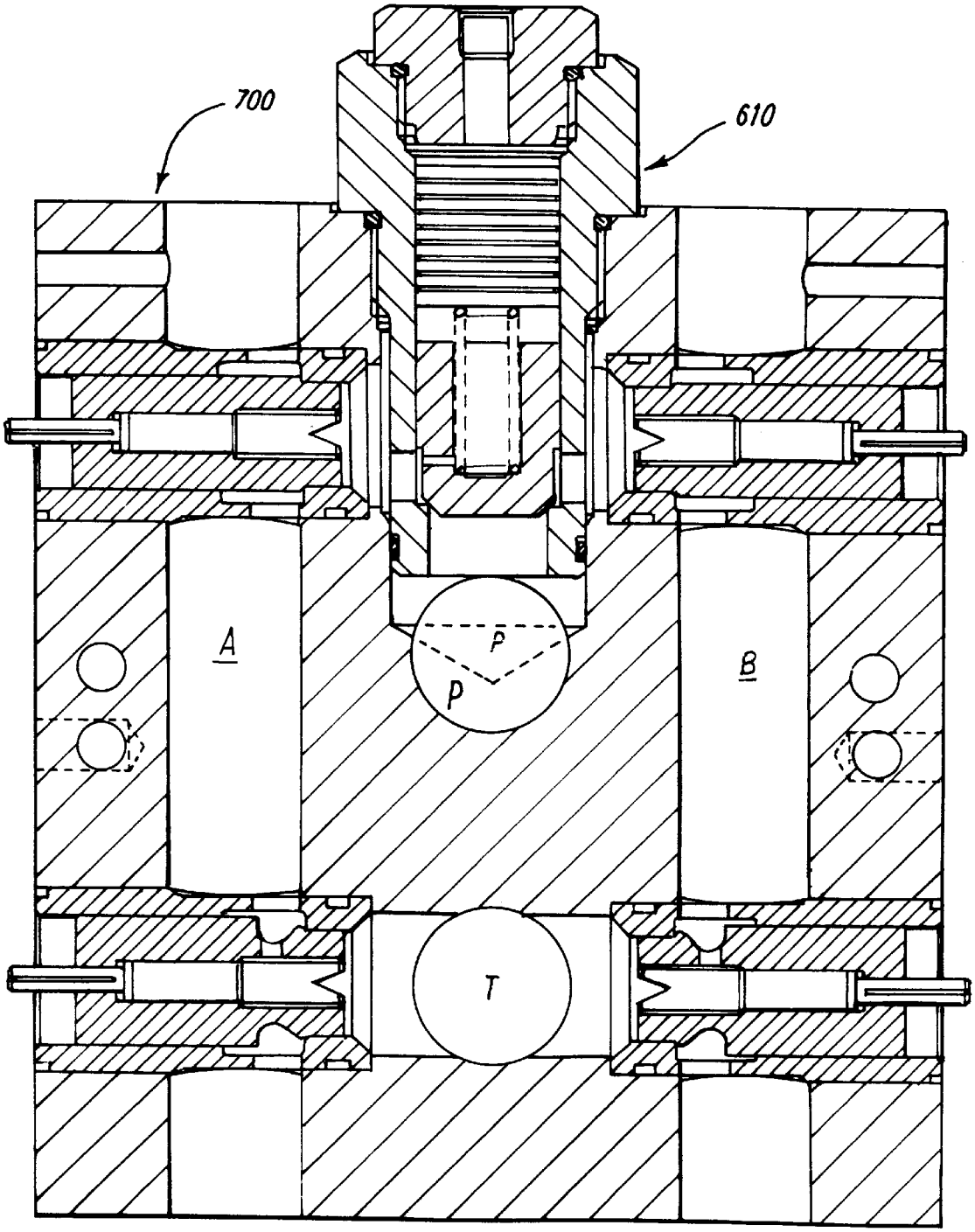
FIG. 7 is a cross-section of part of a control valve assembly incorporating the hydraulic check valve of FIG. 6.

The natural (free or unrestrained) length of the spring 632 exceeds the length of the recess 630 such that even if the piston 626 has moved up the bore 620 to the maximum extent possible (see below), the poppet 622 will be resiliently urged against the valve seat 618. For the configuration shown in FIG. 6, the piston 626 is firmly in contact with the poppet 622 such that the downward force exerted by the piston 626 on the poppet 622 is directly applied and no longer transferred via the spring 632. In FIG. 7 the valve 610 is shown in a configuration in which the piston 626 is lifted to the top of the bore 620 such that downward force on the poppet 622 is applied by the relatively extended spring 632.

Variable mutual longitudinal separation of the poppet 622 and piston 626 is enabled (without dependence on leakage along the bore 620) by means of a breathing port 634 drilled radially through the poppet 622 and into the lower end of the recess 630.

The top of the bore 620 is closed and sealed by a screwed-in cap 636 having a port 638 by which an external source of hydraulic pressure (not shown) can be communicated with a pressurisable chamber 640 defined by the upper end of the bore 620 between the top of the piston 626 and the underside of the cap 636.

In this embodiment the valve housing 612 is externally formed with a mounting thread 642 and an enlarged hexagonal end 644 by which the valve 610 may be screwed into a suitable bore in a valve block (see FIG. 7) to form part of a hydraulic control assembly. When the valve 610 is mounted in the valve block bore (as shown in FIG. 7), upper and lower seals 646 and 648 seal the housing 612 to the valve block and mutually isolate the inlet and outlet ports 614 and 616 except by way of the internal passage controlled by abutment of the poppet 622 with the valve seat 618 in the manner detailed below.

Operation of the hydraulic check valve 610 will now be detailed, it being assumed that the valve 610 is mounted and sealed into a valve block as described above, and that a source of selectively variable hydraulic control pressure is connected to the chamber 640 by way of the port 638 in the cap 636.

If the chamber 640 is initially depressurised and freely vented, the piston 626 will be urged upwards against the cap 636 by the spring 632, and the poppet 622 will engage the valve seat 618 with a force determined by the bias of the spring 632, in the absence of any pressure differential across the valve 610 (i.e. between the inlet and outlet ports 614, 616). In this mode, the poppet 622 will lift off the valve seat 618 when there is a differential pressure from the inlet 614 (relatively high pressure) to the outlets 616 (relatively low pressure) and hydraulic fluid will flow from X to Y (as denoted in FIG. 6). Conversely, if the pressure differential reverses such that there is relatively high pressure at the outlets 616 and relatively low pressure at the inlet 614, the poppet 622 will sealingly engage the valve seat 618 and remain seated so long as this reverse pressure differential pertains, thereby automatically blocking reverse flow from Y to X and so acting (in these circumstances) as a simple check valve or one-way valve.

If the chamber 640 is now pressurised, the piston 626 will "bottom" on the poppet 622 and exert a valve-closing force dependent on the level of pressure applied to the chamber 640. This valve-closing force represents a correspondingly increased pressure differential in the forward flow direction (X to Y) necessary before the poppet 622 will lift off the valve seat 618 such that actual forward flow can commence. Selective variation of pressure applied to the chamber 640 controls the level of differential pressure necessary for there to be forward flow. Design-controlled factors affecting the relationship between control pressure and threshold differential pressure include the end area of the piston 626, and the area of the poppet 622 exposed to inlet pressure when the valve is closed (substantially the area enclosed by the valve seat 618).

Even when the chamber 640 is pressurised, reverse flow (Y to X) continues to be prevented by the automatic closure of the poppet 622 against the valve seat 618 during conditions of reverse pressure differential.

Even if the piston 626 should become unintentionally separated from the poppet 622, eg. due to acceleration, vibration or shock, the spring 632 will continue to bias the poppet 622 towards and against the valve seat 618, thereby to preserve the automatic check valve function.

Modifications and variations of the above-described check valve are possible. For example, the poppet 622 need not be associated with a valve seat 618 formed within the housing 612; the housing 612 could be shortened and the substitute valve seat (not shown) be formed within the valve block or other assembly that the modified valve 610 is mounted on or within.

As shown in FIG. 7, the check valve 610 (of FIG. 6) can also be used within a bank 700 of poppet valves (similar to the arrangement 400 of FIG. 4, but without the pilot stages which are omitted in FIG. 7 for clarity), the effect of the check valve 610 being to convert the operation of the poppet valve assembly 700 from parallel operation (with a conventional uncontrolled valve assembly) to tandem operation (with the externally controlled check valve 610).

While certain modifications and variations of the invention have been described above, the invention is not restricted thereto, and other modifications and variations can be adopted without departing from the scope of the invention as defined in the appended claims.

In the foregoing description reference has been made to double acting applications, ie applications having two service ports. It should be appreciated that the present invention may also be used in single acting Applications, for example lift cylinders on fork lift trucks which do not need pressure on the lowering phase as this is achieved by gravity.

We claim:

1. A control valve for controlling the flow of fluid through the valve in proportional dependence upon a variable control input, the control valve comprising flow control means providing a controllably variable fluid throughput in use of the control valve, said throughput being controlled in dependence upon pressure in a control chamber fed with fluid tapped from the upstream side of the valve via a control element, fluid being drained from the chamber under external control to vary pressurisation of the chamber as the control input to the control valve, the control element being coupled to the flow control means to vary the feed to the control chamber in dependence upon the fluid throughput and in a sense providing negative feedback.

2. A control valve as claimed in claim 1 where in the fluid whose flow is to be controlled by the control valve is a hydraulic fluid.

3. A control valve as claimed in claim 1 wherein the control element is a variable flow restriction disposed to provide a flow restriction which reduces with increased fluid throughput through the flow control means of the valve, the flow restriction conversely increasing with reduced fluid throughput through the flow control means of the valve.

4. A flow-amplifying hydraulic control valve for controlling the flow of fluid through the valve in proportional dependence upon a variable control flow which is volumetrically small relative to the controlled throughflow, the control valve comprising a valve housing having a fluid inlet and a fluid outlet mutually joined by an internal fluid passage, a valve seat bounding the internal fluid passage, a bore in the valve housing, the bore intersecting the fluid passage in the region of the valve seat, an obturator controllably movable along the bore towards and away from the valve seat respectively to reduce and to increase the flow of fluid through the valve in use of the control valve, the obturator and the valve seat being shaped and dimensioned such that a forward pressure differential across the valve arising from the fluid pressure in the fluid inlet instantaneously exceeding the fluid pressure in the fluid outlet tends to increase displacement of the obturator from the valve seat and thereby tends to increase fluid throughput, the end of the obturator remote from the valve seat and that end of the bore together defining a variable-volume control chamber, pressurisation of the control chamber tending to decrease displacement of the obturator from the valve seat thereby to tend to decrease fluid throughput, a fluid conduit tapping the internal fluid passage between the fluid inlet and the valve seat, the fluid conduit feeding tapped fluid to the control chamber, a variable flow restriction means in the fluid conduit to provide variable restriction of fluid being fed to the control chamber, the variable flow restriction means being coupled to the obturator such that increased displacement of the obturator from the valve seat causes the flow restriction means to present a reduced restriction to flow of fluid into the control chamber and, conversely, such that decreased displacement of the obturator from the valve seat causes the flow restriction means to present an increased restriction to flow of fluid into the control chamber, and means permitting drainage of fluid from the control chamber at an externally controllable rate whereby controlled flow of fluid through the control chamber is amplified as a controlled throughput of fluid from the fluid inlet to the fluid outlet.

5. A control valve is claimed in claim 4 wherein the fluid conduit is formed in the obturator to lead from a tapping point adjacent the region of contact between the obturator and the valve seat, the tapping point being on the upstream side of said region, the fluid conduit leading by way of the fluid restriction means to a fluid discharge in the end of the obturator remote from the valve seat.

6. A control valve as claimed in claim 5 wherein the fluid restriction means comprises a throttling element partially plugging the fluid discharge in the end of the obturator, the throttling element moving relative to the obturator with movement of the obturator.

7. A control valve as claimed in claim 6 wherein the throttling element is held substantially static with respect to the valve housing such as to penetrate the fluid discharge to an extent which varies with movement of the obturator along the bore.

8. A control valve as claimed in claim 7 wherein the fluid discharge is an orifice within the obturator, and the throttling element is a pin dimensioned to be a sliding fit in the orifice, the pin having at least one longitudinal slot in its periphery to carry fluid past the orifice, the length of slot exposed to the fluid conduit upstream of the orifice being variable in proportional dependence on the displacement of the obturator from the valve seat whereby to provide a variable restriction to flow of fluid into the control chamber.

9. A control valve as claimed in claim 8 wherein the throttling element has a position which is adjustable with respect to the valve housing whereby to enable adjustment of the performance characteristic of the control valve.

10. A control valve as claimed in claim 4 wherein the fluid conduit incorporates a check valve to prevent reverse flow from the control chamber back through the fluid conduit and the tapping point in the event of a reverse pressure differential across the valve, the check valve being disposed to prevent transient depressurisation of the control chamber in the event of depressurisation of the normally high pressure fluid inlet, thereby to prevent the control valve acting as an anti-cavitation valve.

11. A control valve as claimed in claim 4 wherein the fluid conduit incorporates a pilot-operated hydraulic check or the like selectively operable to block fluid outflow from the control chamber when the obturator is seated on the valve sent whereby to eliminate leakage through the control valve when the control valve is closed.

12. A control valve as claimed in claim 11 wherein the hydraulic check valve is one which substantially prevents reverse flow through the hydraulic check valve and allows forward flow through the hydraulic check valve only if forward differential pressure exceeds a predetermined level selectively variable in dependence on an externally applied control pressure.

13. A control valve as claimed in claim 12 wherein the hydraulic check valve comprises a valve housing having a fluid inlet and a fluid outlet mutually joined by an internal fluid passage, a valve seat bounding the internal fluid passage, a poppet movable against the valve seat to block the internal fluid passage and movable away from the valve seat to open the internal fluid passage, a piston movable towards and away from the poppet, a spring disposed between the poppet and the piston to bias the poppet towards the valve seat with the spring force being reacted by abutment with the piston, and the piston being subjectable to a selectively variable hydraulic pressure constituting said externally applied control pressure.

14. A control valve assembly comprising a combination of four control valves as claimed in claim 4, the four control valves being interconnected in a bridge array having four nodes in mutually-opposite pairs of nodes, one such pair of nodes being connectable respectively to a hydraulic source and to a hydraulic drain, and the other such pair of nodes being connectable to respective opposite sides of a movable element of a double-acting hydraulic actuator or other hydraulic motor for bi-directional control thereof.

15. A control valve assembly comprising a combination of four control valves as claimed in claim 12 or claim 13 together with a pilot-operated check valve, the four control valves being interconnected in a bridge array having four nodes in first and second mutually-opposite pairs of nodes, the first pair of nodes being connectable respectively to a hydraulic source and to a hydraulic drain, and the second pair of nodes being connectable to respective opposite sides of a movable element of a double-acting hydraulic actuator or other hydraulic motor, the check valve being disposed in the hydraulic path between the hydraulic source and the node connectable to the hydraulic source for tandem control of the hydraulic actuator or other hydraulic motor.

* * * * *

UNITED STATES PATENT AND TRADEMARK OFFICE

CERTIFICATE OF CORRECTION

PATENT NO. : 6,038,957
DATED : March 21, 2000
INVENTOR(S) : Ertmann et al.

It is certified that error appears in the above-identified patent and that said Letters Patent is hereby corrected as shown below:

On the title page, item [56] References Cited

Foreign Patent Documents

"0297682 1/1984 European Pat. Off."
should read --0297682 1/1989 European Pat. Off.--

"2853795 6/1979 Germany"
should read --2853794 6/1979 Germany--

Claim 7, col. 11, line 61, after "housing" delete "such as" and insert --in order--

Claim 11, col. 12, lines 20 and 21, after "hydraulic check" insert --valve-- and delete "or the like" and before "selectively" insert --means--

Claim 15, col. 12, line 55, delete "or claim 13"

Signed and Sealed this

Sixth Day of March, 2001

*Attest:*

Nicholas P. Godici

NICHOLAS P. GODICI

*Attesting Officer*

*Acting Director of the United States Patent and Trademark Office*